US009553402B2

(12) United States Patent
Thelen

(10) Patent No.: US 9,553,402 B2
(45) Date of Patent: Jan. 24, 2017

(54) ELECTRICAL PLUG CONNECTOR WITH PLUG-IN CONNECTION AND CABLE OUTLET MEMBER

(71) Applicant: Telegaertner Karl Gaertner GmbH, Steinenbronn (DE)

(72) Inventor: Maik Thelen, Holzgerlingen (DE)

(73) Assignee: Telegaertner Karl Gaertner GmbH, Steinenbronn (DE)

( * ) Notice: Subject to any disclaimer, the term of this patent is extended or adjusted under 35 U.S.C. 154(b) by 0 days.

(21) Appl. No.: 14/659,694

(22) Filed: Mar. 17, 2015

(65) Prior Publication Data

US 2015/0280360 A1 Oct. 1, 2015

(30) Foreign Application Priority Data

Mar. 28, 2014 (DE) ..... 10 2014 104 446

(51) Int. Cl.

| | |
|---|---|
| ***H01R 13/58*** | (2006.01) |
| ***H01R 13/502*** | (2006.01) |
| ***H01R 13/59*** | (2006.01) |
| ***H01R 13/6592*** | (2011.01) |

(52) U.S. Cl.

CPC ..... *H01R 13/5825* (2013.01); *H01R 13/502* (2013.01); *H01R 13/59* (2013.01); *H01R 13/6592* (2013.01)

(58) Field of Classification Search

CPC ..... H01R 13/5825
USPC ..... 439/460, 461, 462, 582, 584, 467, 465
See application file for complete search history.

(56) References Cited

U.S. PATENT DOCUMENTS

| | | | | |
|---|---|---|---|---|
| 4,005,922 | A | 2/1977 | Burkhart et al. | |
| 4,023,879 | A | 5/1977 | Braund et al. | |
| 4,030,741 | A * | 6/1977 | Fidrych | F16L 5/00 174/653 |
| 4,070,085 | A * | 1/1978 | Nelson | H01R 13/512 439/462 |
| 4,114,974 | A * | 9/1978 | Lawrence | H01R 13/5205 439/462 |
| 4,553,111 | A | 11/1985 | Barrow | |
| 4,560,962 | A | 12/1985 | Barrow | |
| 4,641,905 | A | 2/1987 | Poliak et al. | |

(Continued)

FOREIGN PATENT DOCUMENTS

| | | |
|---|---|---|
| AT | 408 820 | 10/2008 |
| CN | 101944692 | 1/2011 |

(Continued)

*Primary Examiner* — Tulsidas C Patel
*Assistant Examiner* — Peter G Leigh
(74) *Attorney, Agent, or Firm* — Lipsitz & McAllister, LLC

(57) ABSTRACT

An electrical plug connector with a plug-connection member and a cable outlet member is provided. The cable outlet member has a cable guidance channel for guiding and a cable clamping arrangement for fixing a cable which is connected to the plug-connection member. The cable outlet member has a first and a second housing shell and also a cap nut. The second housing shell is movable between an open position which releases the first housing shell and a closed position which covers the first housing shell. The cable clamping arrangement has clamping wedges which are arranged on the inner sides of the housing shells which face each other. The cap nut in the closed position of the second housing shell is able to be screwed onto the two housing shells.

14 Claims, 8 Drawing Sheets

(56) References Cited

U.S. PATENT DOCUMENTS 4,653,836 A 3/1987 Peele
4,671,598 A * 6/1987 Keehne ..... H01R 13/6593 439/607.47
4,935,093 A 6/1990 Reeb
4,990,094 A 2/1991 Chandler et al.
5,104,333 A 4/1992 Hatagishi et al.
5,178,554 A 1/1993 Siemon et al.
5,186,647 A 2/1993 Denkmann et al.
5,211,576 A * 5/1993 Tonkiss ..... H01R 13/59 439/462
5,295,869 A 3/1994 Siemon et al.
5,299,956 A 4/1994 Brownell et al.
5,300,734 A 4/1994 Suzuki
5,310,363 A 5/1994 Brownell et al.
5,326,284 A 7/1994 Bohbot et al.
5,362,257 A 11/1994 Neal et al.
5,391,095 A 2/1995 Born
5,414,393 A 5/1995 Rose et al.
5,432,484 A 7/1995 Klas et al.
5,435,752 A 7/1995 Siemon et al.
5,439,388 A 8/1995 Weiss et al.
5,488,201 A 1/1996 Liu
5,586,914 A 12/1996 Foster, Jr. et al.
5,647,767 A 7/1997 Scheer et al.
5,700,167 A 12/1997 Pharney et al.
5,941,734 A 8/1999 Ikeda et al.
5,967,853 A 10/1999 Hashim
5,971,796 A 10/1999 Duhr
6,010,354 A 1/2000 Cunningham
6,083,031 A 7/2000 Kuo
6,089,923 A 7/2000 Phommachanh
6,095,852 A 8/2000 Gregory, II
6,116,945 A * 9/2000 Davis ..... H01R 13/5825 439/354
6,123,572 A 9/2000 Ishii et al.
6,139,355 A 10/2000 Puerner
6,149,455 A * 11/2000 Levi ..... H01R 13/59 439/321
6,157,542 A 12/2000 Wu
6,165,023 A 12/2000 Troutman et al.
6,179,667 B1 1/2001 Espenshade et al.
6,305,950 B1 10/2001 Doorhy
6,319,070 B1 11/2001 Tan
6,333,472 B1 12/2001 Weatherley
6,371,793 B1 4/2002 Doorhy et al.
6,379,157 B1 4/2002 Curry et al.
6,394,844 B1 5/2002 Frias Valero et al.
6,416,364 B1 7/2002 Shi et al.
6,464,541 B1 10/2002 Hashim et al.
6,497,588 B1 12/2002 Scharf et al.
6,508,669 B2 * 1/2003 Wang ..... H01R 13/59 439/353
6,520,808 B2 2/2003 Forbes et al.
6,558,185 B1 5/2003 Stockel et al.
6,579,128 B1 6/2003 Wu
6,648,674 B1 * 11/2003 Dobler ..... H01R 13/5841 439/455
6,684,179 B1 1/2004 David
6,840,779 B2 1/2005 Eberle et al.
6,966,798 B1 11/2005 Wu
7,040,925 B2 5/2006 Beerwerth et al.
7,249,979 B2 7/2007 Gerber et al.
7,304,241 B2 * 12/2007 Trieb ..... H01R 9/032 174/74 R
7,396,251 B2 * 7/2008 Kuo ..... H01R 13/595 439/447
7,540,789 B2 6/2009 Gerber et al.
7,559,790 B2 7/2009 Boeck et al.
7,578,695 B2 8/2009 Boeck et al.
7,604,515 B2 10/2009 Siemon et al.
7,621,674 B2 * 11/2009 Szilagyi ..... G02B 6/3885 385/53
7,641,503 B1 * 1/2010 van der Horn .... H01R 13/5812 439/457
7,641,504 B1 1/2010 Padruzzi
7,689,089 B2 3/2010 Wagner et al.
7,815,445 B2 10/2010 Wu et al.
7,938,674 B2 * 5/2011 Lindkamp ..... H01R 13/59 439/461
7,988,476 B2 * 8/2011 Billman ..... H01R 13/5202 439/271
8,040,692 B2 10/2011 Hetzer et al.
8,182,285 B2 5/2012 Annequin et al.
8,192,224 B2 6/2012 Schmidt et al.
8,246,377 B2 8/2012 Lindkamp et al.
8,262,406 B2 9/2012 Lindkamp
8,298,922 B2 10/2012 Schumann et al.
8,376,779 B2 2/2013 Metral et al.
8,435,065 B2 5/2013 Littek et al.
8,814,598 B2 * 8/2014 Hein ..... H01R 13/5812 439/455
9,130,283 B1 9/2015 Lin
9,325,163 B2 * 4/2016 Pelletier ..... H02G 3/0658
2002/0009930 A1 1/2002 Chang
2002/0025713 A1 2/2002 Tabata
2002/0146930 A1 10/2002 Williams
2003/0157842 A1 8/2003 Arnett et al.
2003/0171024 A1 9/2003 Mossner et al.
2004/0203292 A1 10/2004 Eberle et al.
2004/0209523 A1 10/2004 Milner et al.
2005/0118881 A1 6/2005 Aekins et al.
2005/0136747 A1 6/2005 Caveney et al.
2005/0153580 A1 7/2005 Schilling
2005/0159036 A1 7/2005 Caveney et al.
2005/0176302 A1 8/2005 Beerwerth et al.
2006/0060374 A1 3/2006 Trieb et al.
2006/0183359 A1 8/2006 Gerber et al.
2007/0190656 A1 8/2007 Crain et al.
2007/0202752 A1 8/2007 Schumann et al.
2008/0057793 A1 3/2008 Gerber et al.
2008/0096417 A1 4/2008 Boeck et al.
2008/0188120 A1 8/2008 Tsuji
2008/0200059 A1 8/2008 Boeck et al.
2009/0147495 A1 6/2009 Hetzer et al.
2010/0015858 A1 1/2010 Gerber et al.
2010/0233900 A1 9/2010 Gimbel
2010/0279529 A1 11/2010 Ng Vern Shen et al.
2011/0065309 A1 3/2011 Lindkamp et al.
2011/0070766 A1 3/2011 Lindkamp et al.
2011/0117770 A1 5/2011 Lindkamp
2011/0212652 A1 9/2011 Schmidt et al.
2011/0300740 A1 12/2011 Schumann et al.

FOREIGN PATENT DOCUMENTS

DE 84 15 489 8/1984
DE 34 39 629 4/1986
DE 9216186 3/1993
DE 691 15 863 5/1996
DE 196 49 668 5/1998
DE 200 12 572 2/2001
DE 199 38 367 3/2001
DE 100 51 097 3/2002
DE 102 42 143 3/2004
DE 10 2005 038 540 1/2007
DE 10 2006 049 563 4/2008
DE 10 2007 008 465 8/2008
DE 10 2007 029 593 1/2009
DE 10 2008 064 535 6/2010
EP 0577035 1/1994
EP 0 982 815 3/2000
EP 1 096 620 5/2001
EP 1 693 933 8/2006
EP 2045884 4/2009
EP 2 299 547 3/2011
EP 2 302 743 3/2011
EP 2 323 228 5/2011
EP 2426786 3/2012
GB 2 120 021 11/1983
GB 2 157 900 10/1985
JP S54-79990 11/1952
JP S61-65677 5/1986
JP S62-173181 11/1987

(56) References Cited

FOREIGN PATENT DOCUMENTS

| | | |
|---|---|---|
| JP | 2001520799 | 10/2001 |
| JP | 2003504824 | 2/2003 |
| JP | 2005235547 | 9/2005 |
| JP | 2012508952 | 4/2012 |
| WO | 99/40651 | 8/1999 |
| WO | WO 02/17442 | 2/2002 |
| WO | WO 2008/025180 | 3/2008 |

* cited by examiner

ELECTRICAL PLUG CONNECTOR WITH PLUG-IN CONNECTION AND CABLE OUTLET MEMBER

This application claims the benefit of German application number 10 2014 104 446.0 filed on Mar. 28, 2014, which is incorporated herein by reference in its entirety and for all purposes.

BACKGROUND OF THE INVENTION

The invention relates to an electrical plug connector with a plug-connection member which can be plug-connected to a complementarily configured plug-connection member to produce an electrical connection, and with a cable outlet member which has a cable guidance channel for guiding and a cable clamping arrangement for fixing a cable which is connected to the plug-connection member.

Such electrical plug connectors are used to produce an electrical connection between two cables or alternatively to produce an electrical connection between a cable and an electrical appliance. For this, a cable may be connected in conventional manner to electrical contact elements of the plug-connection member and be guided via a cable guidance channel of the cable outlet member. The plug-connection member may be configured as a plug which can be inserted into a complementary female connector, or alternatively as a female connector into which a complementarily configured plug can be inserted. In order to avoid the possibility of tensile forces being exerted on the plug-connection member via the cable, the cable outlet member has a cable clamping arrangement with which the cable can be clamped. The cable clamping arrangement thus forms a strain relief means.

Electrical plug connectors of the type referred to first hereinbefore are known for example from EP 2 323 228 A2. The electrical plug connector described in this publication has an insulating body with a square collar which surrounds an opening and has a circumambient recess with latching cut-outs. Furthermore, the electrical plug connector has an angled strain relief element with a U-shaped rail which surrounds a connection opening on three sides. The rail has latching noses and latching hooks, and can be inserted into the recess of the insulating body until it latches.

An electrical plug connector is known from EP 2 299 547 A1 in which the cable outlet member is connected in one piece with the plug-connection member and forms a strain relief element with a plurality of wedge-shaped thickened portions which point radially outwards and which are pressed radially inwards into the cable guidance channel by screwing a cap nut onto the cable outlet member, and thereby can fix a cable arranged in the cable guidance channel.

It is an object of the present invention to improve an electrical plug connector of the generic type such that it is easier to handle.

SUMMARY OF THE INVENTION

This object is achieved according to the invention in an electrical plug connector of the type referred to first hereinbefore in that the cable outlet member has a first and a second housing shell and also a cap nut, the second housing shell being movable between an open position which releases the first housing shell and a closed position which covers the first housing shell, and the cable clamping arrangement has clamping wedges which are arranged on inner sides of the housing shells which face each other, and the cap nut in the closed position of the second housing shell can be screwed onto the two housing shells.

The plug connector according to the invention is distinguished by simplified handling, because in order to introduce the cable into the cable guidance channel a second housing shell of the cable outlet member can be moved into an open position relative to a first housing shell, in which position the second housing shell releases the first housing shell. This makes it easier to introduce the cable into the cable guidance channel. The second housing shell can then be transferred into its closed position and the second housing shell can be secured in its closed position on the first housing shell by means of a cap nut. The housing shells have, on the inner sides which face each other, clamping wedges between which the cable can be positioned, and the cable can be clamped by screwing the cap nut onto the housing shells.

It is beneficial if the second housing shell is held non-detachably on the first housing shell.

Preferably the second housing shell is mounted on the first housing shell so that it can be moved back and forth between the open position and the closed position.

It is advantageous if the second housing shell is mounted pivotably on the first housing shell. The second housing shell can be pivoted relative to the first housing shell about a pivot axis. The pivot axis is beneficially oriented obliquely or perpendicular to a longitudinal axis of the plug-connection member. This means that the first housing shell can be released on the side remote from the plug-connection member by pivoting the second housing shell into its open position. This makes it easier to introduce the cable into the cable guidance channel.

In a preferred embodiment of the invention, the cable clamping arrangement has a cable clamping element with at least two clamping jaws which are connected rigidly to at least one guide bar, with the at least one guide bar being held so as to be linearly displaceable and to resist rotation on at least one housing shell and the two clamping jaws being able to be introduced into the cable guidance channel by screwing the cap nut onto the housing shells and being able to be laid against the clamping wedges.

The clamping jaws can be linearly displaced in the cable guidance channel by screwing the cap nut onto the housing shells. In so doing, they can slide along the clamping wedges which are arranged on the inner sides of the housing shells. The clamping wedges guide the clamping jaws radially inwards into the cable guidance channel. This has the advantage that cables with different diameters can be fixed in the cable guidance channel by means of the clamping jaws, in particular even cables with diameters which are smaller than the distance between the clamping wedges in the closed position of the second housing shell.

In order to prevent the at least two clamping jaws from twisting when the cap nut is screwed onto the housing shells, the cable clamping element has at least one guide bar, which forms an anti-rotation means. The at least one guide bar is held so as to be linearly displaceable and to resist rotation on one or alternatively on both housing shells. Upon introduction of the clamping jaws into the cable guidance channel, the at least one guide bar slides in the longitudinal direction of the cable guidance channel along at least one housing shell, but cannot be twisted. Since the at least one guide bar is connected rigidly to the clamping jaws, the guide bar which slides along the at least one housing shell ensures that the clamping jaws do not twist when the cap nut is screwed on either.

It is advantageous if the two housing shells form a housing of the cable outlet member, the housing having a cylindrical end section which bears an external thread and has at least one elongate aperture in which a guide bar is held so as to be displaceable. By pivoting the second housing shell into its open position, the housing of the cable outlet member can be opened in a simple manner. The two housing shells jointly form a cylindrical end section of the housing of the cable outlet member. The cylindrical end section bears an external thread and has at least one elongate aperture, that is to say an aperture which is oriented parallel to the longitudinal axis of the external thread. In the aperture there is arranged a guide bar which is rigidly connected to the at least two clamping jaws of the clamping element. Upon introduction of the clamping jaws into the cable guidance channel, the guide bar slides along the lateral limits of the elongate aperture. The elongate aperture in such case ensures that the guide bar can move merely in the longitudinal direction, but cannot execute a rotary movement.

Preferably the elongate aperture is arranged between the two housing shells. In the region of the aperture, the second housing shell thus assumes a distance from the first housing shell in its closed position as well. Between the first housing shell and the second housing shell is arranged the elongate aperture, which is delimited by the two housing shells.

In an advantageous embodiment of the invention, the aperture extends at least over the entire length of the external thread of the housing of the cable outlet member.

It is advantageous if the clamping element has two guide bars located diametrically opposed to one another which in each case can be introduced into an aperture arranged between the two housing shells. The provision of the two guide bars increases the mechanical stability of the clamping element, and furthermore has the advantage that the introduction of the guide bars into the apertures is simplified. Jamming of the guide bars in the elongate apertures is avoided.

Further simplification of the handling of the electrical plug connector according to the invention is achieved in one advantageous embodiment in that the clamping jaws and the at least one guide bar are held on a supporting ring which together with the clamping jaws and the at least one guide bar can be inserted into the cap nut. The two clamping jaws and the guide bar together with the supporting ring form a component which can be inserted into the cap nut before the cap nut is screwed onto the two housing shells. When the cap nut is screwed on, the cable clamping element is introduced into the cable guidance channel and the clamping jaws are moved in the longitudinal direction in the cable guidance channel and slide along the clamping wedges. The at least one guide bar ensures that the clamping jaws perform merely an axial movement, but not a rotary movement.

The cap nut, in an advantageous configuration of the invention, has a step which is directed radially inwards, against which the supporting ring lies. The supporting ring can thus be supported by the cap nut in a structurally simple manner via the step.

Preferably the clamping jaws are oriented with their end regions which are remote from the supporting ring obliquely inwards into the cable guidance channel. In such case, provision may be made for the clamping jaws to have a constant material thickness practically over their entire axial length, with the external and internal diameters of the clamping jaws however decreasing with increasing distance from the supporting ring.

The clamping jaws are produced from an elastically deformable material, in particular from a plastics material.

It is beneficial if the clamping jaws are connected in one piece to the at least one guide bar.

In an advantageous embodiment of the invention, the clamping element has a holding ring which is connected to the at least one guide bar and surrounds the housing shells in the peripheral direction. This increases the mechanical stability of the clamping element. Whereas the clamping jaws assume a position within the cable guidance channel and the at least one guide bar preferably assumes a position in an elongate aperture between the two housing shells, the holding ring assumes a position outside the cable guidance channel by surrounding the two housing shells in the peripheral direction. The internal diameter of the holding ring for this purpose is selected to be greater than the external diameter of the external thread onto which the cap nut can be screwed.

The holding ring can advantageously be placed on the cap nut. Upon screwing onto the two housing shells, the cap nut can thus push the holding ring in front of itself and thereby exert a thrust force on the clamping element in a structurally simple manner.

The clamping element is advantageously configured as a one-part moulded plastics part.

It is advantageous if a resilient shield contact element is held on at least one housing shell, which element can be pressed against shielding of a cable. An electrically conductive connection between the shielding of the cable and at least one housing shell can be achieved via the shield contact element in a structurally simple manner. The housing shells are produced from an electrically conductive material, in particular from a die-casting material, and therefore have a good shielding characteristic and also high mechanical stability.

It is particularly beneficial if a shield contact element is held at least on the second housing shell. If the second housing shell is transferred into its closed position, the shield contact element which is held on the second housing shell is pressed against the shielding of the cable which is positioned in the cable guidance channel.

The description below of an advantageous embodiment of the invention, in conjunction with the drawings, serves to explain the invention in greater detail.

DETAILED DESCRIPTION OF THE INVENTION

Figure 1:
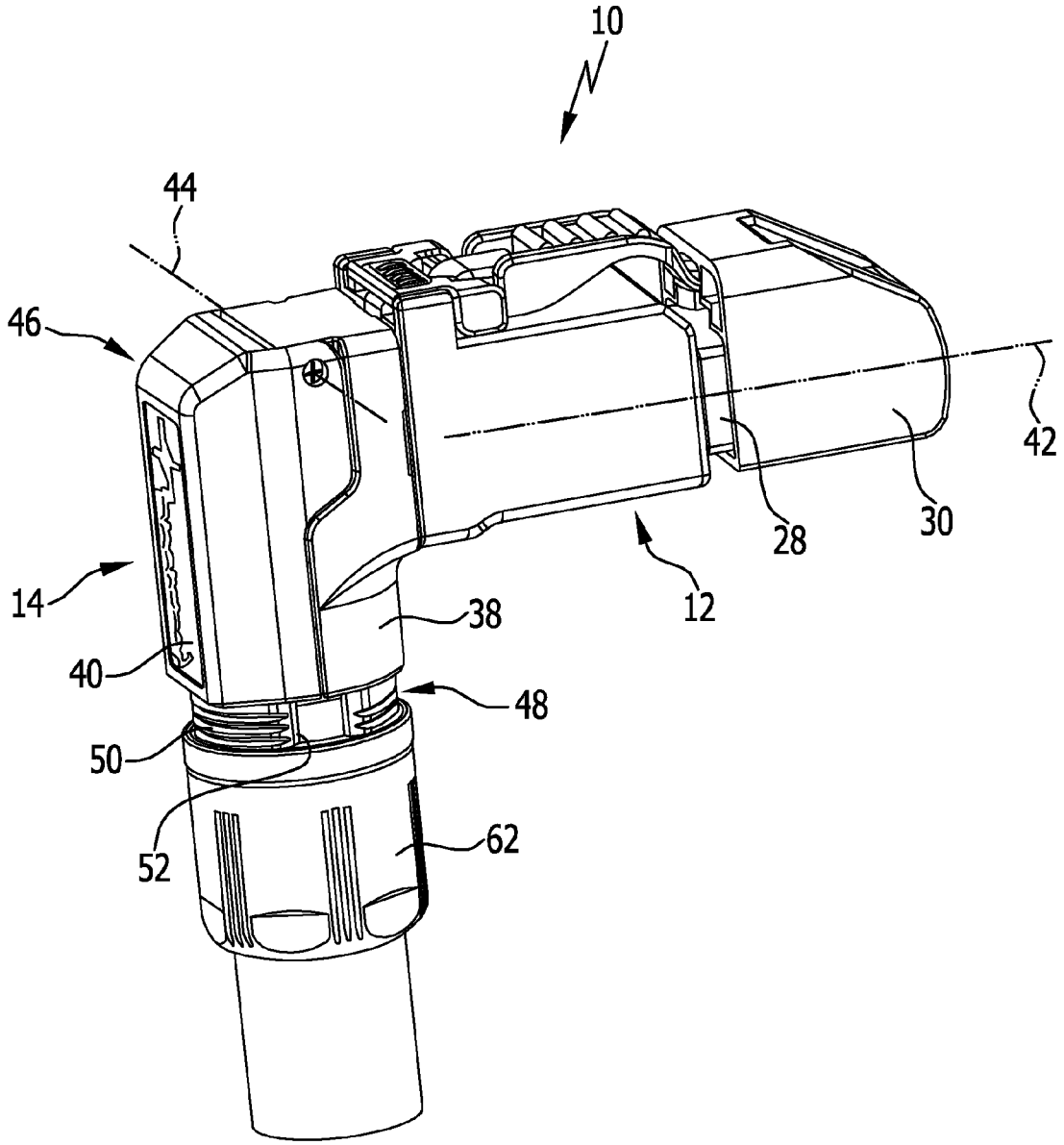
FIG. 1: shows a perspective view of an electrical plug connector with a cable outlet member which has two housing shells and a cap nut screwed onto the housing shells.
Figure 2:
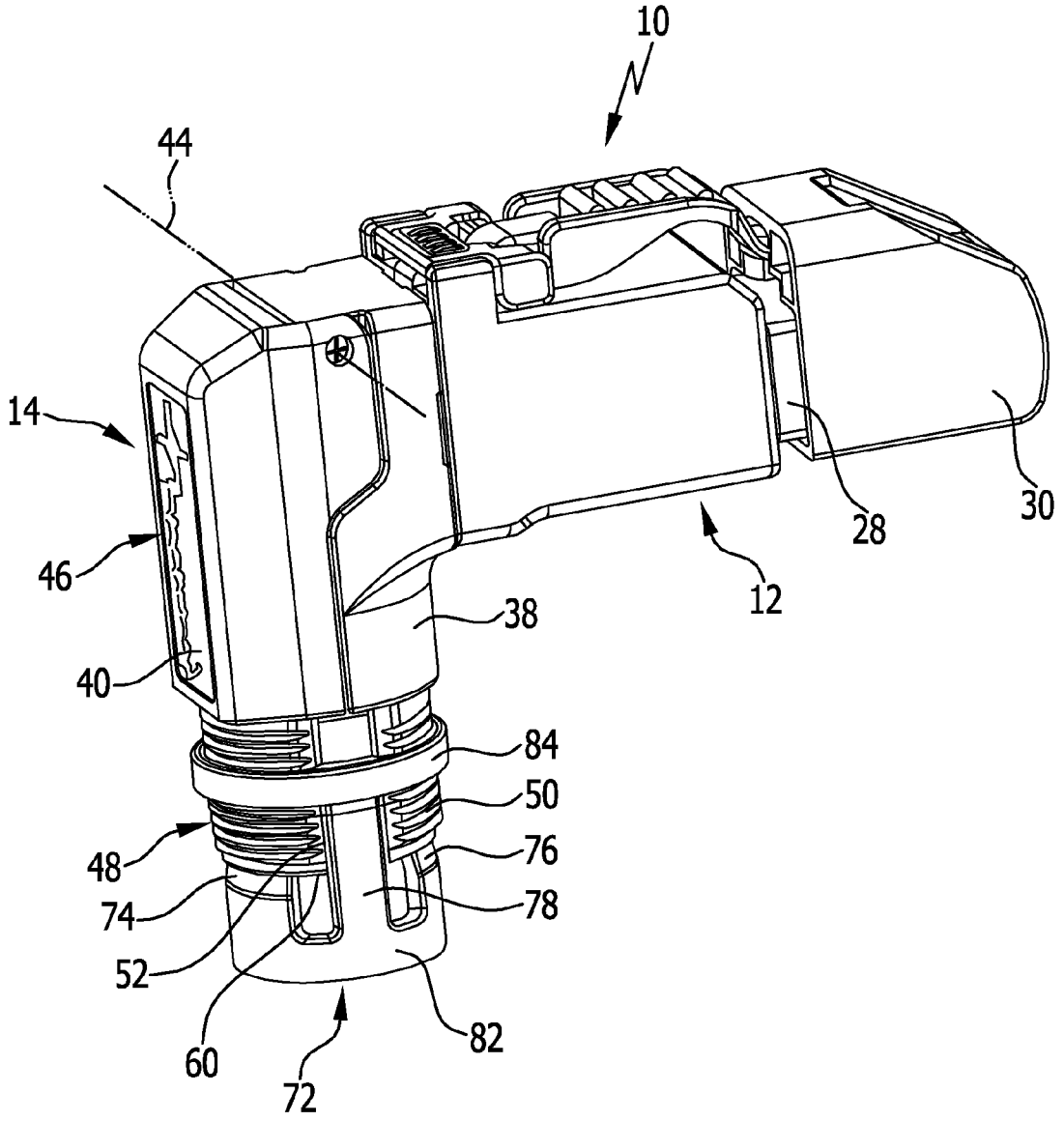
FIG. 2: shows a perspective view of the electrical plug connector of FIG. 1, the cap nut having been removed.
Figure 3:
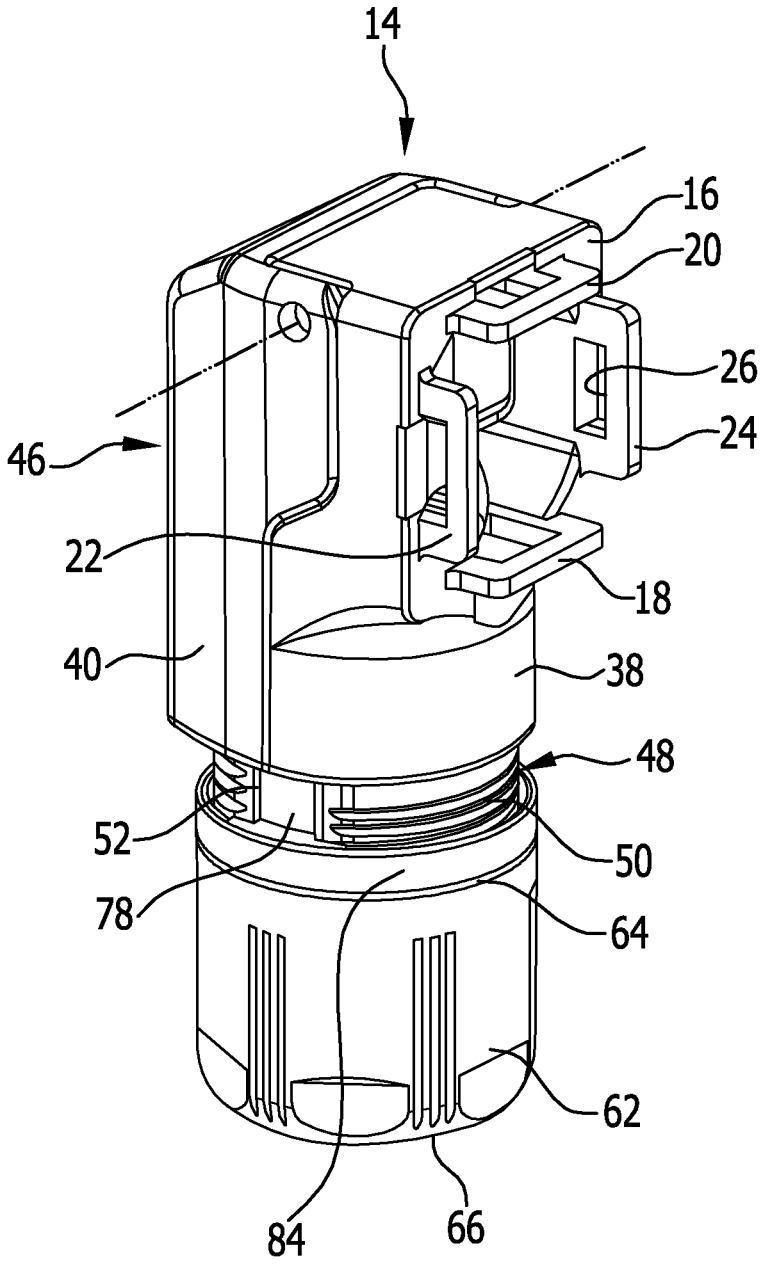
FIG. 3: shows a perspective view of the cable outlet member of FIG. 1.

The drawings show diagrammatically an advantageous embodiment of an electrical plug connector according to the invention which is assigned overall the reference numeral 10. The electrical plug connector 10 has a plug-connection member 12 and a cable outlet member 14. The cable outlet member 14 can be connected detachably to the plug-connection member 12. To this end, a total of four connection lugs 18, 20, 22, 24 are arranged on an end face 16 of the cable outlet member 14 which faces the plug-connection member 12, which lugs each have an aperture 26 and can be introduced into associated recesses which are arranged on the rear side of the plug-connection member 12 which faces the cable outlet member 14.

The plug-connection member 12 can be inserted with a front end section 28 remote from the cable outlet member 14, which section is configured as a connecting plug, into a connecting socket known to the person skilled in the art. On the front end section 28, the plug-connection member 12 has electrical contact elements for producing an electrical connection with corresponding electrical contact elements of the connecting socket. In the example of embodiment illustrated, the front end section 28 including the electrical contact elements of the connection member 12 is covered by a protective cap 30 which can be placed on the front end section 28. The front end section 28 could alternatively also be configured as a connecting socket into which a complementarily configured connecting plug can be inserted.

The cable outlet member 14 has a cable guidance channel 32 through which a cable connected to the electrical contact elements of the plug-connection member 12 can be passed. In the example of embodiment illustrated, the cable guidance channel 32 is formed angled and comprises a front end section 34 which faces the plug-connection member 12 and a rear end section 36 remote from the plug-connection member 12, the rear end section 36 in the example of embodiment illustrated being oriented perpendicular to the front end section 34. Provision may however also be made for the rear end section 36 to be oriented flush or at an acute angle to the front end section 34.

Figure 5:
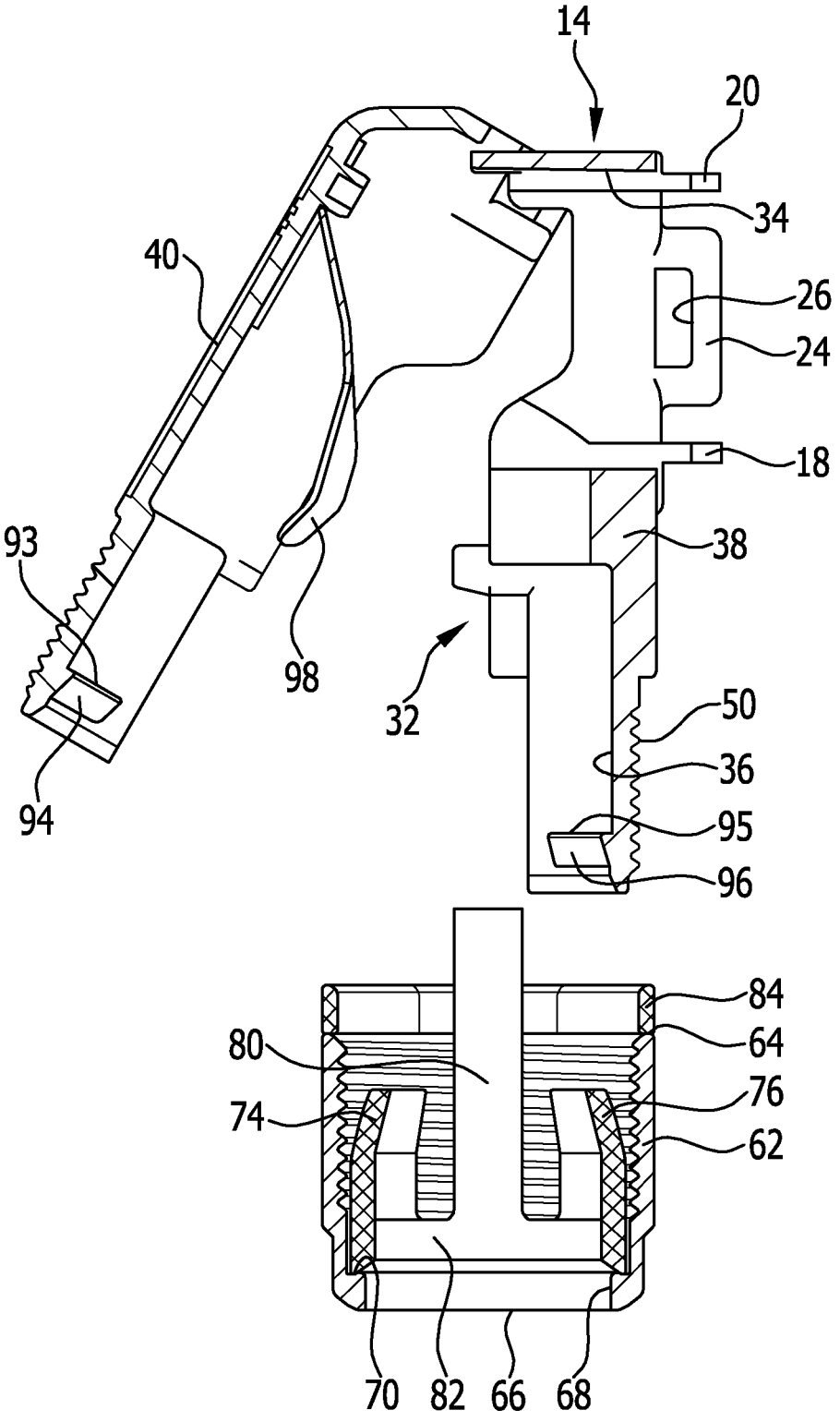
FIG. 5: shows a sectional view of the cable outlet member of FIG. 3, with a second housing shell assuming an open position relative to a first housing shell, and the cap nut together with the cable clamping element being arranged at a distance from the housing shells.
Figure 6:
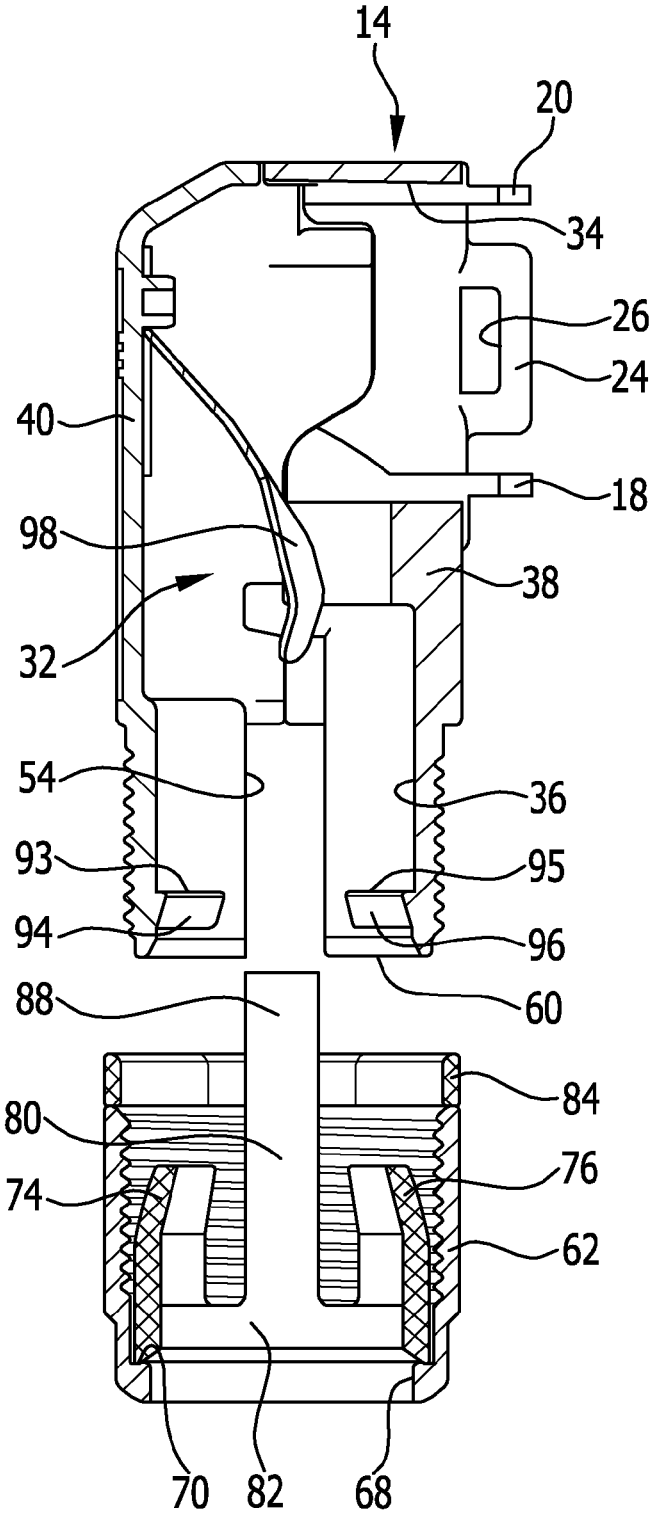
FIG. 6: shows a sectional view of the cable outlet member corresponding to FIG. 5, the second housing shell assuming a closed position.
Figure 7:
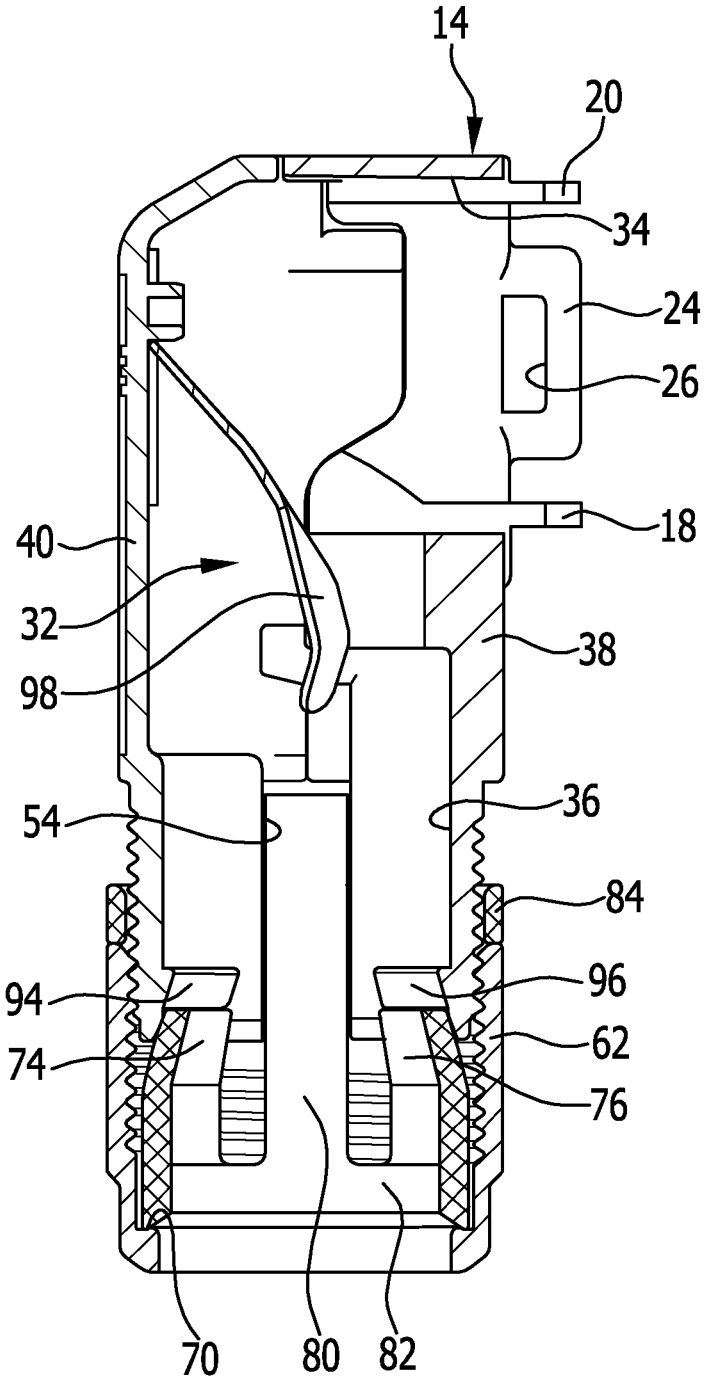
FIG. 7: shows a sectional view of the cable outlet member corresponding to FIG. 5, the cap nut being screwed onto the two housing shells.
Figure 8:
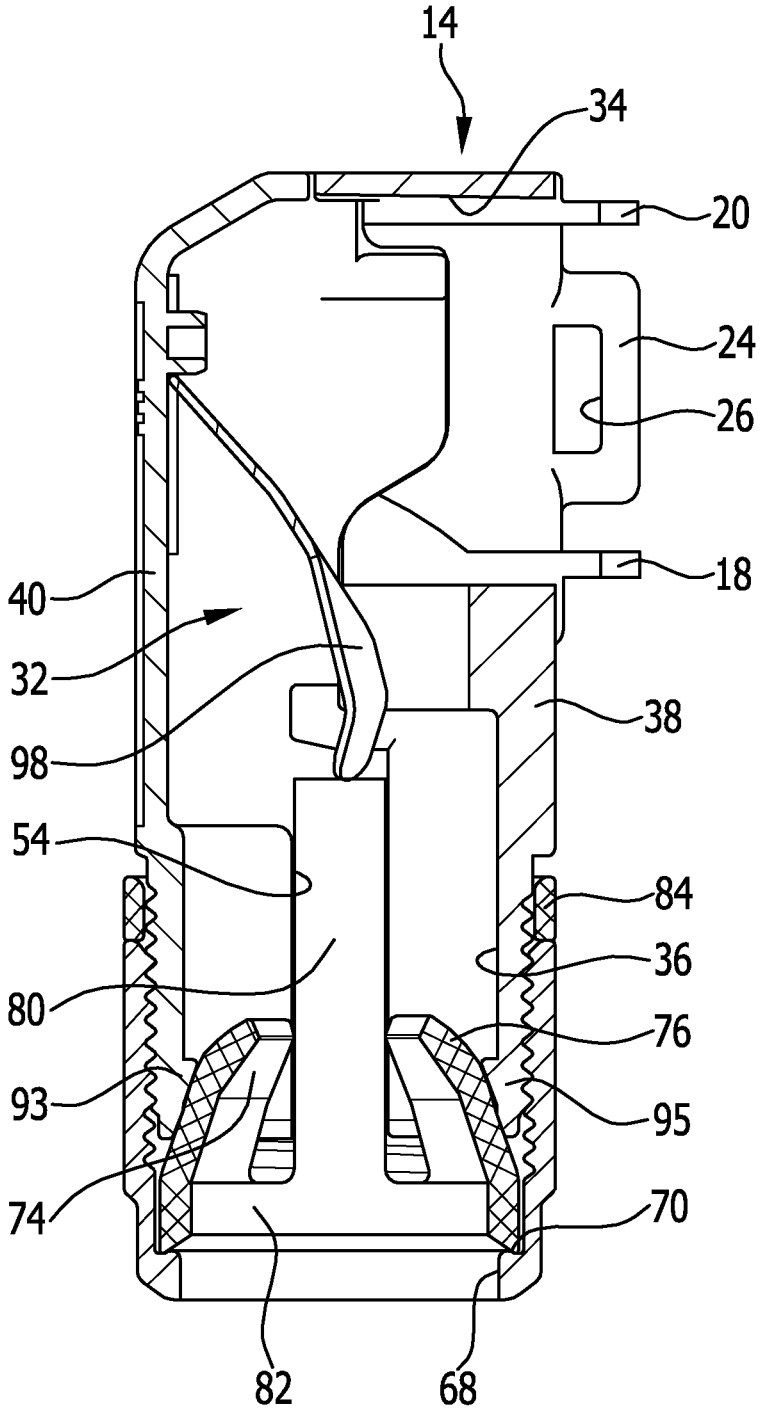
FIG. 8: shows a sectional view of the cable outlet member corresponding to FIG. 5, the cap nut which is screwed onto the housing shells having reached its end position.

The cable outlet member 14 has a first housing shell 38 and a second housing shell 40. The first housing shell 38 can be connected detachably to the plug-connection member 12 by means of the connection lugs 18, 20, 22 and 24, and the second housing shell 40 in the embodiment illustrated is mounted on the first housing shell 38 so as to be pivotable about a pivot axis 44 oriented perpendicular to a longitudinal axis 42 of the plug-connection member 12. The second housing shell 40 can be pivoted back and forth between an open position illustrated in FIG. 5, in which it releases the first housing shell 38, and a closed position illustrated in particular in FIGS. 6, 7 and 8, in which it covers the first housing shell 38.

The two housing shells 38, 40 form a housing 46 of the cable outlet member 14 with a cylindrical end section 48 remote from the plug-connection member 12, which section bears an external thread 50.

The cylindrical end section 48 has two elongate apertures 52, 54 located diametrically opposed to one another which extend over the entire length of the external thread 50 and open into the end 60 of the housing 46 which is remote from the plug-connection member 12. The elongate apertures 52, 54 are arranged between the two housing shells 38, 40 and are thus on one hand delimited by the first housing shell 38 and on the other hand by the second housing shell 40.

A cap nut 62 can be screwed onto the external thread 50. The second housing shell 40 can thus be secured in its closed position on the first housing shell 38 by means of the cap nut 62.

The cap nut 62 has a front edge 64 which faces the housing 46, and on its rear side 66 remote from the front edge 64 the cap nut 62 has a cable passage 68 which is surrounded by a step 70 which is directed radially inwards.

Figure 4:
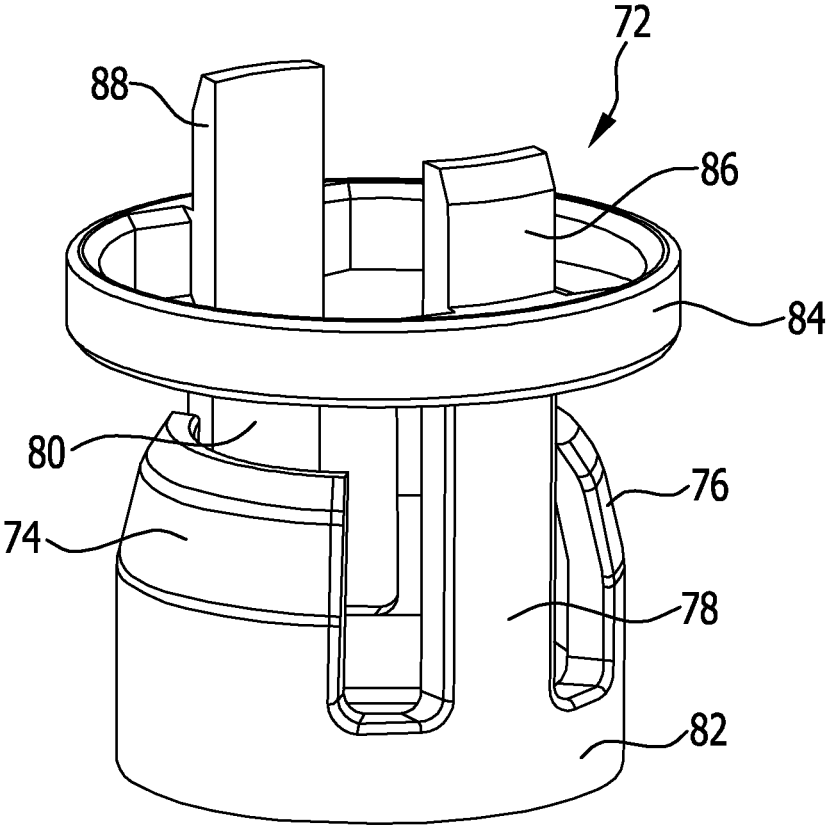
FIG. 4: shows a perspective view of a cable clamping element of the electrical plug connector of FIG. 1.

In order to clamp a cable introduced into the cable guidance channel 32 securely, the cable outlet member 14 comprises a cable clamping arrangement with a cable clamping element 72 which is shown enlarged in FIG. 4, and with clamping wedges 93, 95 which are explained in greater detail below. The cable clamping element 72 has two elastically deformable clamping jaws 74, 76 which are located diametrically opposed to one another, and also two guide bars 78, 80 which are located diametrically opposed to one another between the clamping jaws 74, 76. The clamping jaws 74, 76, just like the guide bars 78, 80, are connected in one piece with a supporting ring 82 and can be inserted into the cap nut 62 before the cap nut 62 is screwed onto the external thread 50. The supporting ring 82 can be supported on the step 70 of the cap nut 62 which is directed radially inwards. This becomes clear in particular from FIG. 5.

The clamping jaws 74, 76 have a constant material thickness practically over their entire length, but the external diameter and the internal diameter of the clamping jaws 74, 76 decrease with increasing distance from the supporting ring 82. With their front end regions which are remote from the supporting ring 82, the clamping jaws 74, 76 are thus inclined radially inwards into the cable guidance channel 32.

In addition to the supporting ring 82, the cable clamping element 72 has a holding ring 84 which upon insertion of the cable clamping element 72 into the cap nut 62 can be positioned on the front edge 64 of the cap nut 62. The holding ring 84 is connected in one piece to the guide bars 78, 80.

The guide bars 78, 80 protrude over the holding ring 84 with their front end regions 86, 88 which are remote from the supporting ring 82. When screwing on the cap nut 62, into which the cable clamping element 72 has previously been inserted, the front end regions 86, 88 of the guide bars 78, 80 may be inserted in each case into an elongate aperture 52, 54. Then the cap nut 62 can engage with the external thread 50 and be screwed onto the external thread 50. In such case, the guide bars 78, 80 slide along the two housing shells 38, 40 in the apertures 52, 54. The guide bars 78, 80 ensure that when the cap nut 62 is screwed onto the external thread 50 the cable clamping element 72 is moved merely in the axial direction, but cannot execute a rotary movement.

The clamping wedges 93, 95 of the cable clamping arrangement which have already been mentioned are arranged on the inner sides of the housing shells 38, 40 which face each other, directly adjacent to the end 60 of the housing 46. The clamping wedges 93, 95 have inclined faces 94, 96 which are directed obliquely inwards. When the cap nut 62 is screwed on, the free end regions of the clamping jaws 74, 76 which are inclined radially inwards slide along the inclined faces 94, 96 and are supported thereby in the radial direction to the outside. This becomes clear in particular from FIGS. 7 and 8.

The second housing shell 40 bears on its inner side an elastically deformable shield contact element 98 which protrudes into the cable guidance channel 32, and just like the first housing shell 38 and the second housing shell 40 is manufactured from an electrically conductive material, preferably a metal. The housing shells 38, 40 are preferably manufactured from a die-casting material. The plug-connection member 12 too has an electrically conductive housing, so that effective electromagnetic shielding is achieved by the use of the electrically conductive housing shells 38, 40 and the use of the electrically conductive housing of the plug-connection member 12.

As has already been mentioned, a multi-strand electrical cable can be connected to the electrical contact elements of the plug-connection member 12. To this end, the cable can be guided through the cable passage 68 of the cap nut 62 and the supporting ring 82 and the holding ring 84 of the cable clamping element 72. The cable can then be guided through the cable guidance channel 32, the second housing shell 40 being able to assume its open position in order to facilitate the introduction of the cable into the cable guidance channel 32. Before introduction of the cable into the cable guidance channel 32, the shielding of the cable can be released. The individual strands of the cable can be connected to electrical contact elements of the plug-connection member 12. Then the second housing shell 40 can be pivoted into its closed position, with the cable being bent and the shield contact element 98 contacting the shielding of the cable. Finally, then the cap nut 62 can be screwed onto the external thread 50, the holding ring 84 surrounding the external thread 50 in the peripheral direction and the two clamping jaws 74, 76 receiving the cable between them. If the cap nut 62 has reached its end position, the clamping jaws 74, 76 clamp the cable in the cable guidance channel 32, so that tensile loading of the cable is not transmitted to the electrical contact elements to which the individual strands of the cable are connected. If a relatively thick cable is used, the cable clamping element 72 can be dispensed with and the cable can be clamped between the clamping wedges 93, 95.

The invention claimed is:

1. An electrical plug connector, comprising:

a plug-connection member which is adapted to be plug-connected to a complimentary plug-connection member configured to produce an electrical connection, a cable outlet member comprising a cable guidance channel for guiding a cable and a cable clamping arrangement for fixing the cable which is connected to the plug connection member, the cable outlet member comprising a first and a second housing shell and a cap nut, the second housing shell being movable between an open position which releases the first housing shell and a closed position which covers the first housing shell, the cable clamping arrangement comprising clamping wedges which are arranged on inner sides of the first and second housing shells which face each other, and in the closed position of the second housing shell, the cap nut being adapted to be screwed onto the first and second housing shells, wherein:

the cable clamping arrangement further comprises a cable clamping element with at least two clamping jaws which are connected rigidly to at least one guide bar, with the at least one guide bar being held so as to be linearly displaceable parallel to a central longitudinal axis and to resist rotation on at least one of the first or second housing shell, and the at least two clamping jaws are adapted to be introduced into the cable guidance channel by screwing the cap nut onto the first and second housing shells and laid against the clamping wedges when the cap nut is screwed onto the first and second housing shells.

2. The electrical plug connector according to claim 1, wherein the second housing shell is mounted on the first housing shell so that the second housing shell is movable back and forth between the open position and the closed position.

3. The electrical plug connector according to claim 2, wherein the second housing shell is mounted pivotably on the first housing shell.

4. The electrical plug connector according to claim 1, wherein the two housing shells form a housing of the cable outlet member, the housing having a cylindrical end section which bears an external thread and has at least one elongate aperture in which the at least one guide bar is held so as to be displaceable.

5. The electrical plug connector according to claim 4, wherein the at least one elongate aperture is arranged between the two housing shells.

6. The electrical plug connector according to claim 4, wherein the at least one elongate aperture extends at least over an entire length of the external thread.

7. The electrical plug connector according to claim 1, wherein:

the at least one guide bar comprises two guide bars; and the two guide bars are located diametrically opposed to one another and are each adapted to be introduced into an elongate aperture arranged between the two housing shells.

8. The electrical plug connector according to claim 1, wherein the at least two clamping jaws and the at least one guide bar are held on a supporting ring which together with the at least two clamping jaws and the at least one guide bar is insertable into the cap nut.

9. The electrical plug connector according to claim 8, wherein the cap nut has a step which is directed radially inwards, against which the supporting ring lies.

10. The electrical plug connector according to claim 8, wherein the at least two clamping jaws are directed with end regions thereof which are remote from the supporting ring obliquely inwards into the cable guidance channel.

11. The electrical plug connector according to claim 1, wherein the cable clamping element has a holding ring which is connected to the at least one guide bar and surrounds the two housing shells in a peripheral direction.

12. The electrical plug connector according to claim 11, wherein the holding ring is adapted to be placed on the cap nut.

13. The electrical plug connector according to claim 12, wherein a shield contact element is held at least on the second housing shell.

14. The electrical plug connector according to claim 1, wherein a resilient shield contact element is held on at least one housing shell, which resilient shield contact element is adapted to be pressed against shielding of the cable.

* * * * *